US011423743B2

(12) United States Patent
Nelson

(10) Patent No.: US 11,423,743 B2
(45) Date of Patent: Aug. 23, 2022

(54) METHOD, APPARATUS, AND PROGRAM PRODUCT FOR TRIGGERING AND CONTROLLING GAMING MACHINE OPERATION IN REEL-TYPE GAMES

(71) Applicant: Everi Games, Inc., Austin, TX (US)

(72) Inventor: Loren Nelson, Reno, NV (US)

(73) Assignee: Everi Games, Inc., Austin, TX (US)

( * ) Notice: Subject to any disclaimer, the term of this patent is extended or adjusted under 35 U.S.C. 154(b) by 20 days.

(21) Appl. No.: 17/060,333

(22) Filed: Oct. 1, 2020

(65) Prior Publication Data

US 2021/0110664 A1 Apr. 15, 2021

Related U.S. Application Data

(60) Provisional application No. 62/914,522, filed on Oct. 13, 2019.

(51) Int. Cl.
*G07F 17/34* (2006.01)
*G07F 17/32* (2006.01)

(52) U.S. Cl.
CPC ..... *G07F 17/3267* (2013.01); *G07F 17/3209* (2013.01); *G07F 17/3213* (2013.01); *G07F 17/3258* (2013.01); *G07F 17/34* (2013.01)

(58) Field of Classification Search
CPC ..... G07F 17/326; G07F 17/3209; G07F 17/3213; G07F 17/3258; G07F 17/34
See application file for complete search history.

(56) References Cited

U.S. PATENT DOCUMENTS

2008/0108411 A1* 5/2008 Jensen ..... G07F 17/32 463/20
2009/0117983 A1 5/2009 Visser
2009/0124338 A1* 5/2009 Watkins ..... G07F 17/34 463/20
2010/0016058 A1* 1/2010 Englman ..... G07F 17/34 463/20
2010/0137055 A1* 6/2010 Jaffe ..... G07F 17/34 463/20
2010/0234092 A1* 9/2010 Gomez ..... G07F 17/3265 463/20
2010/0285860 A1* 11/2010 Svanas ..... G07F 17/32 463/20

(Continued)

*Primary Examiner* — Omkar A Deodhar
*Assistant Examiner* — Shauna-Kay N. Hall
(74) *Attorney, Agent, or Firm* — The Culbertson Group, P.C.; Russell D. Culbertson

(57) ABSTRACT

A method includes displaying a first level game symbol array and a second level game symbol array through a display system of a reel-type gaming machine. The first level game symbol array is produced by populating at least some game symbol locations included in an initial array of game symbol locations. Any such populated location may be populated with a first trigger symbol including a representation of a single-symbol reel. The second level game symbol array is displayed by, for each respective game symbol location populated with the first trigger symbol in the first level game symbol array, conducting a respective single-symbol reel spin simulation of the representation of the single-symbol reel. A bonus play is displayed through the gaming machine at least in part in response to a predefined number of second trigger symbols being included in the second level game symbol array.

20 Claims, 12 Drawing Sheets

(56) References Cited

U.S. PATENT DOCUMENTS

| | | | | |
|---|---|---|---|---|
| 2015/0111632 | A1* | 4/2015 | Meyer | G07F 17/34<br>463/20 |
| 2018/0072759 | A1* | 3/2018 | Campbell | A61P 25/08 |

* cited by examiner

METHOD, APPARATUS, AND PROGRAM PRODUCT FOR TRIGGERING AND CONTROLLING GAMING MACHINE OPERATION IN REEL-TYPE GAMES

CROSS-REFERENCE TO RELATED APPLICATION

The Applicant claims the benefit, under 35 U.S.C. § 119(e), of U.S. Provisional Patent Application No. 62/914,522 filed Oct. 13, 2019, and entitled "Method, Apparatus, and Program Product for Triggering and Conducting Bonus Play in Reel-Type Games." The entire content of this provisional application is incorporated herein by this reference.

TECHNICAL FIELD OF THE INVENTION

The invention relates to gaming systems and methods which provide reel-type games. More particularly, the invention relates to gaming systems and methods which provide improved mechanisms for triggering bonus play at a gaming machine and for controlling the gaming machine once play is triggered.

BACKGROUND OF THE INVENTION

Mechanical and video reel-type wagering games display results for a given play in the game using an array of game symbol locations. In the course of a play in a reel-type wagering game (which may be referred to generally as a "slot game"), the various game symbols appearing at the different game symbol locations (or at least some of the different game symbol locations) are randomized or selected according to a random result. The randomization or apparent randomization is performed by spinning a reel which carries on its periphery the various game symbols for the game, or, in the case of video reel-type games, by conducting a reel spin simulation for one or more simulated reels shown on a video display. A reel-type game may include physical or simulated multiple-symbol reels which each provide multiple game symbol locations in the array, or may include physical or simulated single-symbol reels which each show only a single game symbol location of the array.

Winning results may be defined for a given combination of game symbols appearing in a predefined winning game symbol location pattern commonly referred to as a "payline" defined through the array of game symbol locations. Winning results may also be defined in terms of the number of a given game symbol or different game symbols appearing in the array after randomization, commonly referred to as a "scatter pay." The combinations of game symbols which represent a winning result along a payline or as a scatter pay are defined in a pay table which relates each such combination of game symbols to a respective prize, or multiple prizes with each prize corresponding to a bet level in effect for the play in the game. Any prizes as defined by the pay table are awarded in some fashion at the completion of a given play such as by incrementing a credit meter at the gaming machine.

Reel-type gaming machines may offer bonus games in addition to a primary or base game conducted at a gaming machine. Such bonus games are seen as a way to vary the player's gaming experience at a given gaming machine and may involve spins of the same or different physical or simulated reels defining the original game symbol location array. In view of the popularity of bonus games for reel-type gaming machines, there is a continuing need both for new implementations of bonus games and new implementations for triggering bonus games in a base game.

SUMMARY OF THE INVENTION

Aspects of the present invention include methods, apparatus, and program products for triggering bonus play in reel-type gaming machines. Additional aspects of the present invention encompass methods, apparatus, and program products for controlling the operation of reel-type gaming machines.

A method of providing a bonus play in a reel-type gaming machine according to a first aspect of the present invention includes displaying a first level game symbol array and a second level game symbol array through a display system of the gaming machine. The first level game symbol array for a play at the gaming machine is produced by populating at least some game symbol locations included in an initial array of game symbol locations. Each respective game symbol location which is populated in this step is populated with a respective game symbol selected from a first game symbol set which includes a first trigger symbol. This first trigger symbol includes a representation of a single-symbol reel. The second level game symbol array is displayed by, for each respective game symbol location populated with the first trigger symbol in the first level game symbol array, conducting a respective single-symbol reel spin simulation of the representation of the single-symbol reel. These single-symbol reel spin simulations are conducted with a second game symbol set which includes a second trigger symbol.

In accordance with this first aspect of the invention, a bonus play is displayed through the gaming machine at least in part in response to a predefined number of second trigger symbols being included in the second level game symbol array. This bonus play ultimately shows a bonus game result, and the gaming machine then awards prizes accordingly. In particular, methods according to the first aspect of the invention include awarding any prize defined for a winning game symbol group contained in the second level game symbol array, and awarding any prize defined for the bonus game result.

A gaming machine according to a second aspect of the present invention includes a display system, a player input system, and least one processor. At least one memory device of the gaming machine stores instructions which are executable by the at least one processor to produce the first and second level game symbol arrays, display a bonus play through the gaming machine, and award prizes in accordance with the above-described method.

Because methods and gaming machines according to the present invention may be implemented with processing devices operating under the control of program code, another aspect of the present invention includes a program product comprising one or more non-transitory computer readable data storage devices storing program code. The program code is executable by one or more processors such as a gaming machine processor arrangement to perform the operations described above in connection with methods according to the invention. The program code may include first level game program code, second level game program code, bonus game program code, and prize assignment program code. The first level game program code is executable to populate game symbol locations to display the first level game symbol array as set out in the above-described method. The second level game program code may be executable to conduct the single-symbol reel spin simulations to produce and display the second level game symbol array described above. The bonus game program code may be executable to conduct the bonus play, while the prize assignment program code may be executable to award prizes in accordance with the above-described method.

In any of the above-noted aspects of the invention two or more multiple-symbol reel representations may be used to define the initial array of game symbol locations. In these implementations the game symbol locations are populated to display the first level game symbol array by conducting one, or potentially more, multiple-symbol reel spin simulations for each of the multiple-symbol reel representations.

Displaying the bonus play in accordance with any of the above-described aspects of the invention may include controlling the display system of the gaming machine so as to move one or more of the game symbol locations relative to at least one other game symbol location to separate the initial array of game symbol locations and form a bonus array of game symbol locations. This bonus array of game symbol locations includes game symbol locations of the initial array of game symbol locations arranged in at least a first bonus group of game symbol locations and a second bonus group of game symbol locations. After the bonus array of game symbol locations is formed, the display system may be controlled to conduct a respective single-symbol reel spin simulation for some or all of the symbol locations. These single-symbol reel spin simulations may be conducted with a third game symbol set which includes one or more jackpot symbols. In these implementations, the prize for the bonus game result may be defined in terms of a number of jackpot symbols included in at least one of the first bonus group and second bonus group of game symbol locations.

In implementations forming a bonus array of game symbol locations for the bonus game, at least one additional bonus group of game symbol locations may be added in order to increase the number of game symbol locations included in the bonus array of game symbol locations relative to the initial array of game symbol locations. The bonus game may then include conducting a respective single-symbol reel spin simulation for any such added game symbol locations using the same game symbol set as used for the other single-symbol reel spin simulations in the bonus game which includes one or more jackpot symbols. In these implementations an additional prize for the bonus game result may be defined by a number of jackpot symbols included in the at least one additional bonus group of game symbol locations.

Any of the single-symbol reel spin simulations conducted in the bonus game may be conducted multiple times. For example, the bonus game may comprise a free spin game which allows multiple free spins of the single-symbol reel representations making up the bonus array of game symbol locations. Although multiple spins may be possible in the bonus play, some game symbols may be locked in place so that no spin simulation is conducted for that location. For example, where a game symbol location has been populated with the first trigger symbol in the first level game, the game symbol may be locked in place for the bonus play. Additionally, when a game symbol location has been populated with one of the jackpot symbols in the bonus play, that jackpot symbol may be locked in place in that respective game symbol location for a remainder of the duration of the bonus play.

In implementations using the second game symbol set and third game symbol set, these sets may include one or more game symbols showing a numerical value. These numerical values may then be awarded for part of the bonus game result. The numerical values may also be automatically adjusted for a given play of the game in response to a change in a multiplier placed in effect for that play.

These and other advantages and features of the invention will be apparent from the following description of representative embodiments, considered along with the accompanying drawings.

DESCRIPTION OF REPRESENTATIVE EMBODIMENTS

Figure 1:
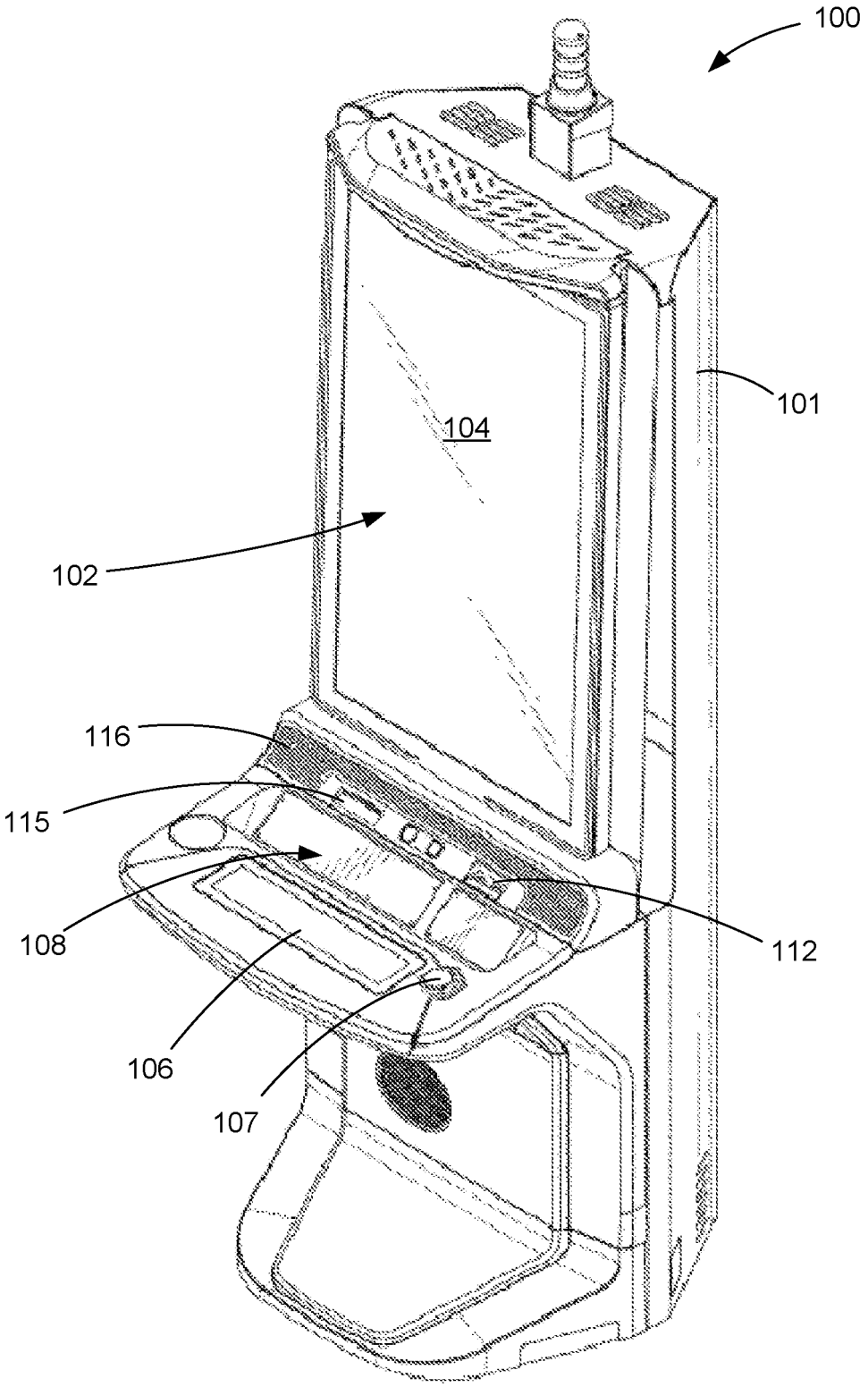
FIG. 1 is a perspective view of a gaming machine that may be used for a target interactive game in accordance with implementations of the present invention.
Figure 2:
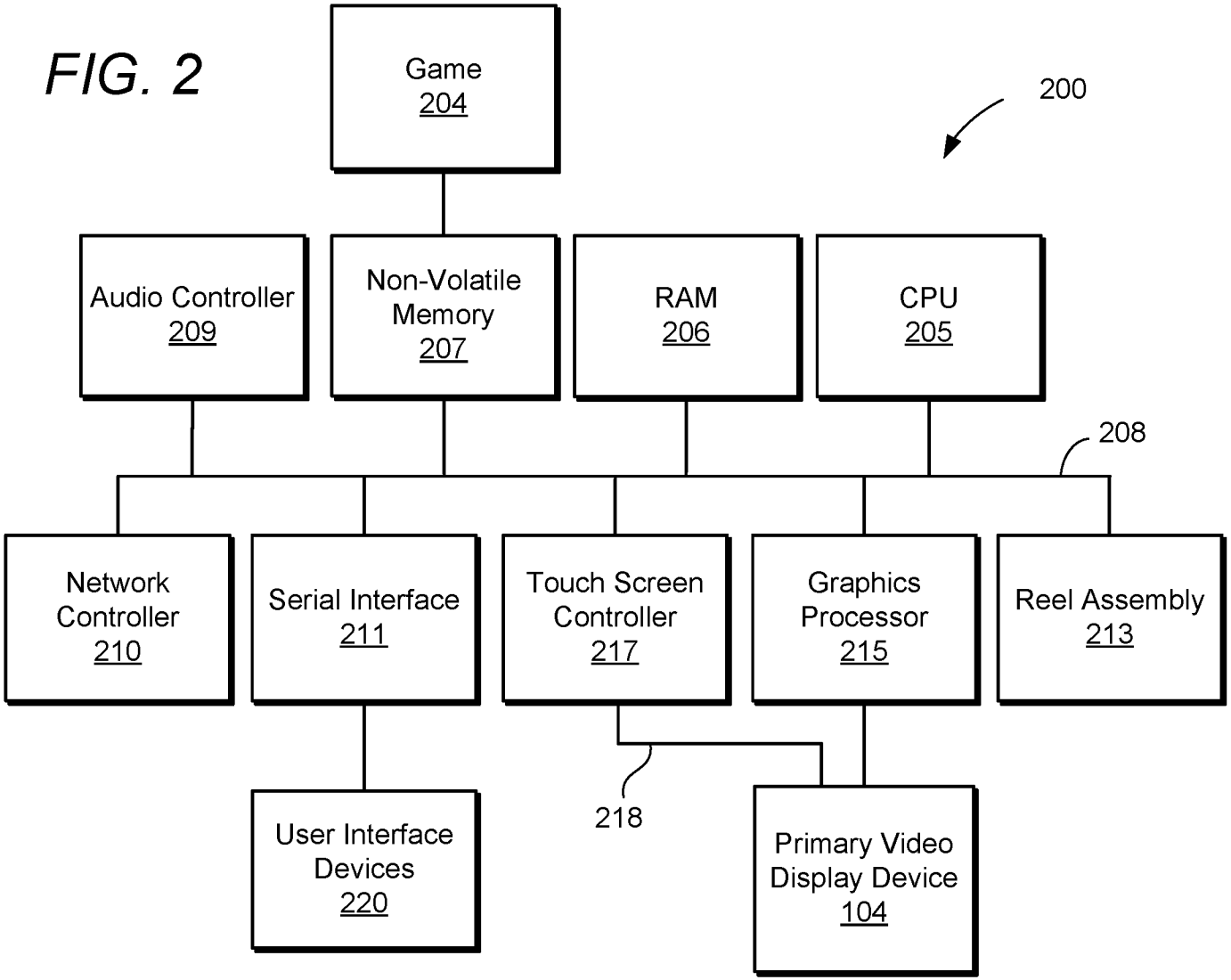
FIG. 2 is a block diagram showing the various components that may be included in the gaming machine shown in FIG. 1.
Figure 3:
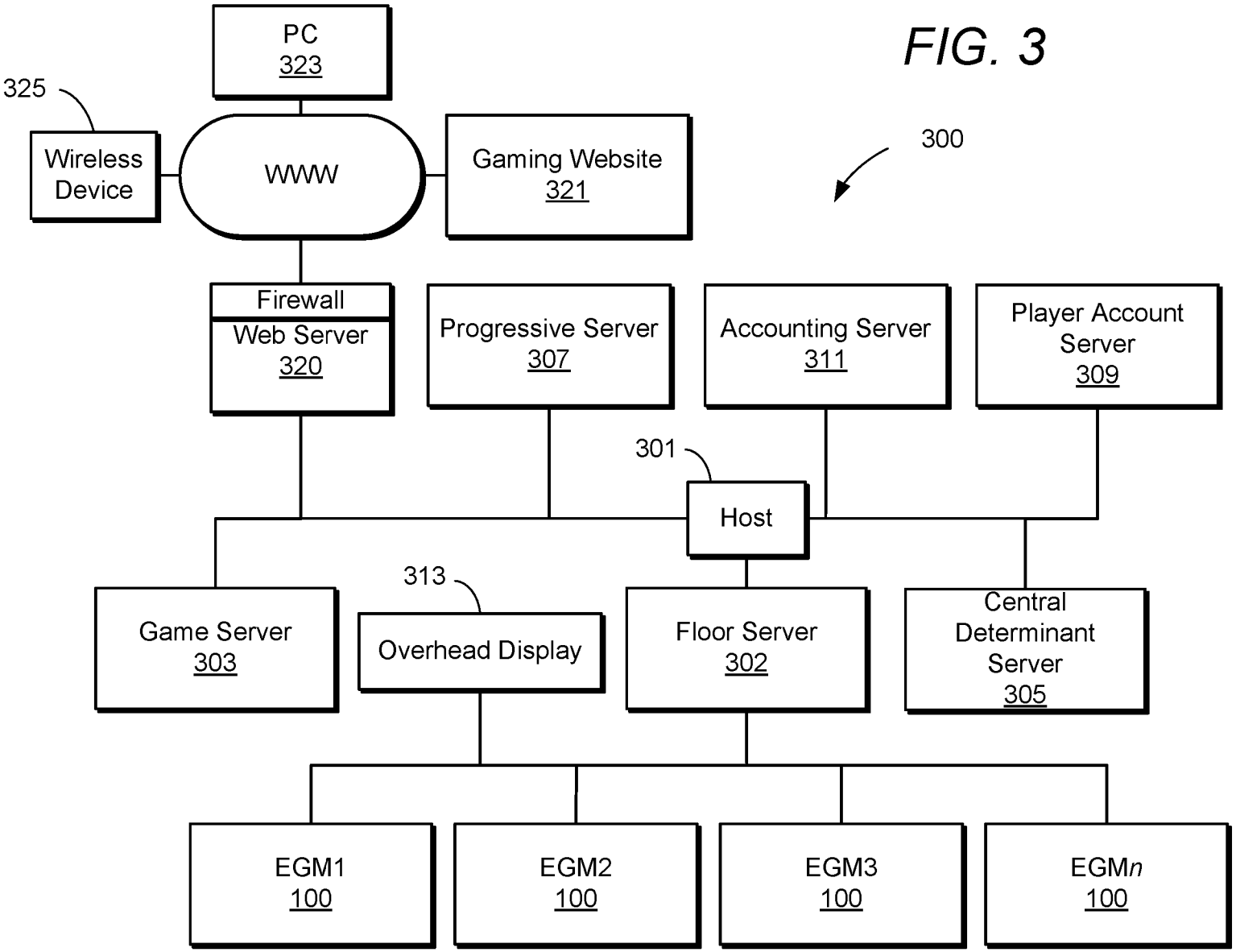
FIG. 3 is a block diagram of a gaming system including gaming machines such as that shown in FIG. 1.
Figure 4A:
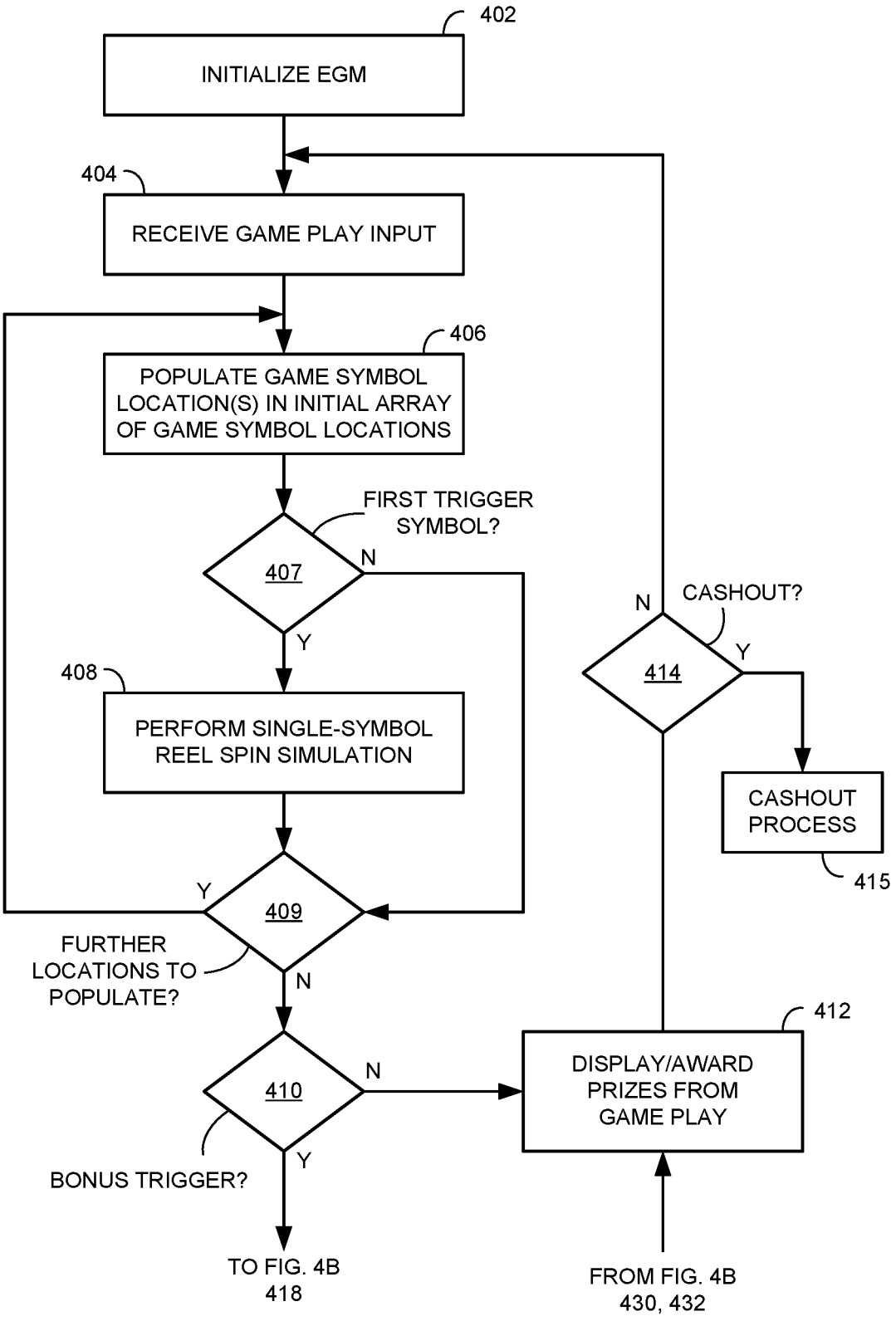
FIG. 4A is a process flow diagram showing a first portion of an example process according to an aspect of the present invention.
Figure 4B:
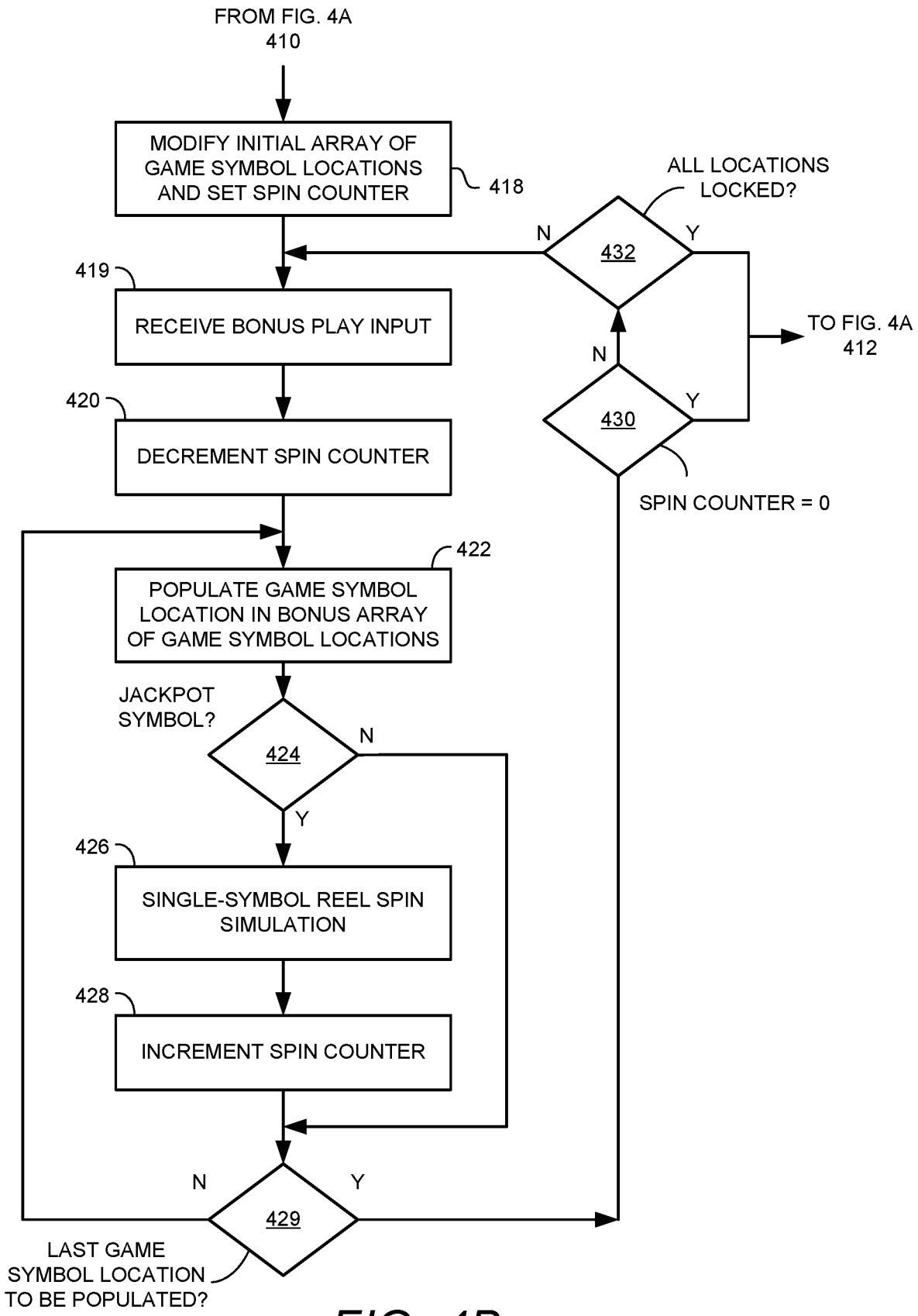
FIG. 4B is a process flow diagram showing a second portion of an example process according to an aspect of the present invention

FIGS. 1-3 will be used to describe gaming machines and gaming networks in which aspects of the present invention may be implemented. FIGS. 4A and 4B will be used to describe example methods of triggering a bonus portion of a game according to various implementations of the present invention as well as conducting a bonus game portion. FIGS. 5-11 will be referenced below to describe an implementation of a bonus game triggering arrangement and bonus game portion according to aspects of the invention.

Referring to FIG. 1, gaming machine 100 includes a cabinet 101 having a front side generally shown at reference numeral 102. A primary video display device 104 is mounted in a central portion of the front side 102, and a touch-screen button panel 106 is positioned below the primary video display device. Gaming machine 100 may include additional smaller auxiliary display devices (not shown) in the area shown generally at 108. It should also be noted that each display device referenced herein may include any suitable display device including a cathode ray tube, liquid crystal display, plasma display, LED display, or any other type of display device currently known or that may be developed in the future. One or more of these video display devices, and especially primary video display device 104, may be used to display graphics associated with a reel-type game and bonus game portion in accordance with aspects of the present invention. As will be described further below in connection with FIG. 2 and elsewhere, it is also possible for gaming machines within the scope of the present invention to include mechanical elements such as mechanical reels. Generally, the display device or display devices of the gaming machine, through which a reel-type game may be presented may be described in this disclosure and the accompanying claims as a "display system" regardless of whether the display arrangement includes video displays showing reel simulations or physical reels, or combinations of the two.

The gaming machine 100 illustrated for purposes of example in FIG. 1 also includes a mechanical control button 107 mounted adjacent to touch-screen button panel 106. This control button 107 may allow a player to make a play input to start a play in a wagering game conducted through gaming machine 100, while virtual buttons included (but not shown in this view) on button panel 106 or other physical buttons or controls (not shown) may allow a player to select a bet level for a game implemented at the gaming machine and select a type of game or game feature. Touch-screen button panel 106 may also be used in implementations of reel-type games encompassing aspects of the invention to allow the player to control a cursor that may be displayed on another display device. Other forms of gaming machines through which the invention may be implemented may include switches, joysticks, or other mechanical input devices, in addition to the virtual buttons and other controls implemented on touch-screen button panel 106. For example, primary video display device 104 in gaming machine 100 provides a convenient display device for implementing touch screen controls in addition to or in lieu of controls included on touch-screen button panel 106 or mechanical controls. The player interface devices which receive player inputs in the course of a game played through the gaming machine, such as controls to select a wager amount for a given play, controls to enter a play input to actually start a given play in the wagering game, or controls to allow a player to make other player inputs in a game according to the present invention, may be referred to generally as a "player input system."

It will be appreciated that gaming machines may also include a number of other player interface devices in addition to devices that are considered player controls for use in entering inputs in the course of a particular game. Gaming machine 100 also includes a currency/voucher acceptor having an input ramp 112, a voucher/receipt printer having a voucher/receipt output 115, and a player card reader (not shown in the view of FIG. 1). Numerous other types of player interface devices may be included in gaming machines that may be used to implement embodiments of the present invention.

Gaming machine 100 may also include a sound system to provide an audio output to enhance the user's playing experience. For example, illustrated gaming machine 100 includes speakers behind grille 116 which may be driven by a suitable audio amplifier (not shown) to provide a desired audio output at the gaming machine.

FIG. 2 shows a logical and hardware block diagram 200 of gaming machine 100 which includes a processor (CPU) 205 along with random access memory (RAM) 206 and nonvolatile memory or storage device 207. All of these devices are connected on a system bus 208 with an audio controller device 209, a network controller 210, and a serial interface 211. A graphics processor 215 is also connected on bus 208 and is connected to drive primary video display device 104 (the display device 104 being mounted on cabinet 101 as shown in FIG. 1). As shown in FIG. 2, gaming machine 100 also includes a touch screen controller 217 connected to system bus 208. Touch screen controller 217 is also connected via signal path 218 to receive signals from a touch screen element associated with primary video display device 104 or touch-screen button panel 106 or both. It will be appreciated that the touch screen element itself typically comprises a thin film that is secured over the display surface of the respective display device such as the display device of touch-screen button panel 106 in FIG. 1. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer, although they may be specially designed and configured for use in a wagering game environment. These elements may be mounted on (or connected to) a standard personal computer motherboard and housed in a standard personal computer housing which itself may be mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller for example. It will also be appreciated that some of the devices shown in FIG. 2 as being connected directly on system bus 208 may in fact communicate with the other system components through a suitable expansion bus. Audio controller 209, for example, may be connected to the system via a PCI or PCIe bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself.

Embodiments of the present invention may include no processor such as CPU 205 or graphics processor such as 215 at the gaming machine, and may instead rely on one or more remote processors. Thus unless specifically stated otherwise, the designation "gaming machine" is used in this disclosure and the accompanying claims to designate a system of devices which operate together to provide the indicated functions. A "gaming machine" may include a gaming machine such as gaming machine 100 shown in FIGS. 1 and 2, which is itself a system of various components, and may also include one or more components remote from a gaming machine cabinet (that is, cabinet 101 in FIG.

1). Thus the designation "gaming machine" encompasses both a stand-alone gaming machine and a gaming machine (that is, the part housed in a cabinet such as cabinet 101 in FIG. 1) along with one or more remote components for providing various functions (such as identifying prizes for a given play and controlling reel spin simulations, and performing other operations described below in the examples of FIGS. 4A and 4B.

It will also be appreciated that graphics processors are also commonly a part of modern computer systems. Although separate graphics processor 215 is shown for controlling primary video display device 104 and secondary video display device 107, CPU 205 or a graphics processor packaged with or included with CPU 205 may control all of the display devices directly without any separately packaged graphics processor. The invention is not limited to any particular arrangement of processing devices for controlling the video display devices included with gaming machine 100. Also, a gaming machine implementing the present invention is not limited to any particular number of video display devices or other types of display devices. While the large display device 104 is particularly suited for showing additional groups of game symbol locations in accordance with some implementations of reel-type games in accordance with aspects of the present invention, the display area may be arranged differently than the portrait orientation shown or divided across multiple discrete display devices within the scope of the present invention.

In the illustrated gaming machine 100, CPU 205 executes software, that is, program code, which ultimately controls the entire gaming machine including the receipt of player inputs and the presentation of the graphics or information displayed according to the invention through the display devices 104 and 106 associated with the gaming machine. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for game software (program code) prior to loading into random access memory 206 for execution, or for programs not in use or for other data generated or used in the course of gaming machine operation. Network controller 210 provides an interface to other components of a gaming system in which gaming machine 100 may be included. An example network will be described below in connection with FIG. 3.

It should be noted that the invention is not limited to gaming machines employing the personal computer-type arrangement of processing devices and interfaces shown in example gaming machine 100. Other gaming machines through which the invention may be implemented may include one or more special purpose processing devices to perform the various processing steps for implementing the invention. Unlike general purpose processing devices such as CPU 205, which may comprise an Intel® or AMD® processor for example, these special purpose processing devices may not employ operational program code to direct the various processing steps.

The example gaming machine 100 is shown in FIG. 2 as including user interface devices 220 (part of a player input system) connected to serial interface 211. These user interface devices may include various player input devices such as mechanical buttons, virtual buttons shown on touch-screen button panel 106 in FIG. 1, and/or levers, and other devices. It will be appreciated that the interface between CPU 205 and other player input devices such as player card readers, voucher readers or printers, and other devices may be in the form of serial communications. Thus serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the diagrammatic representation of FIG. 2 to illustrate that a gaming machine which may present reel-type games in accordance with aspects of the present invention may also include mechanical reels. For example, a number of sets of mechanical reels may replace the primary display device 104, or at least part of that display device. Alternatively, mechanical reels may be included in the gaming machine behind a light-transmissive video display panel. Mechanical reels may also include one or more video display devices in place of a static reel symbol strip and thus be capable of conducting single-symbol reel spin simulations for one or more game symbol locations. In any case, the mechanical reels represent a display device for displaying various game symbols in the course of a game play. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface 211 to control communications with the reel assembly, and may not include a direct bus interconnection as indicated by FIG. 2. Details of a mechanical reel arrangement and various accent lighting arrangements which may be associated with mechanical reels are not shown in the present FIGS. so as to avoid obscuring the present invention in unnecessary detail.

Referring now to FIG. 3, a networked gaming system 300 associated with one or more gaming facilities may include one or more networked gaming machines 100 (shown in FIG. 3 as EGM1-EGMn) connected in the network by suitable network cable or wirelessly. Networked gaming machines 100 and one or more overhead displays 313 may be operatively connected so that the overhead display or displays may mirror or replay the content of one or more displays of gaming machines 100. For example, the primary display content for a given gaming machine 100 (including a game play and bonus play according to the present invention) may be transmitted through network controller 210 to a controller associated with the overhead display(s) 313. In the event gaming machines 100 have cameras installed, the respective player's video images may be displayed on overhead display 313 along with the content of the player's gaming machine display.

The example gaming network 300 shown in FIG. 3 includes a host server 301 and floor server 302, which together may function as an intermediary between floor devices such as gaming machines 100 and back office devices such as the various servers described below. Game server 303 may provide server-based games and/or game services to network connected gaming devices such as gaming machines 100. Central determinant server 305 may be included in the network to identify or select lottery, bingo, or other centrally determined game outcomes and provide the outcome information to networked gaming machines 100 which present the games to players.

Tournament server 306 may be included in the system for controlling or coordinating tournament functions. These functions may include maintaining tournament player scores and ranking in real time during the course of tournament play, and communicating this information to the various gaming machines 100 participating in the tournament. Tournament server 306 may also function to enroll players in tournaments, schedule tournaments, and maintain the time remaining in the various tournaments.

Progressive server 307 may maintain progressive pools for progressive games which may be available through the various gaming machines 100 (such as some prizes defined for the bonus game described further below). In some implementations, progressive server 307 may simply receive communications indicating contribution amounts which have been determined by processes executing at the various gaming machines 100 or elsewhere in the gaming network. Alternatively, progressive server 307 may perform processes to determine the contribution amounts for incrementing the various progressive pools which may be maintained. Progressive server 307 may also periodically communicate current pool values back to the various gaming machines 100, and may participate in communicating awarded progressive prize amounts to the gaming machines and making adjustments to the progressive prize pools accordingly. In some implementations, progressive server 307 may also determine or participate in determining when a progressive prize triggering event occurs.

Accounting server 311 may receive gaming data from each of the networked gaming devices, perform audit functions, and provide data for analysis programs. Player account server 309 may maintain player account records, and store persistent player data such as accumulated player points and/or player preferences (for example, game personalizing selections or options).

Example gaming network 300 also includes a gaming website 321 which may be hosted through web server 320 and may be accessible by players via the Internet. One or more games may be displayed as described herein and played by a player through a personal computer 323 or handheld wireless device 325 (for example, a Blackberry® cell phone, Apple® iPhone®, personal digital assistant (PDA), iPad®, etc.). To enter website 321, a player may log in with a user name that may, for example, be associated with the player's account information stored on player account server 309. Once logged in to website 321 the player may play various games on the website, including games according to the invention. Also website 321 may allow the player to make various personalizing selections and save the information so it is available for use during the player's next gaming session at a casino establishment having the gaming machines 100.

It will be appreciated that gaming network 300 illustrated in FIG. 3 is provided merely as an example of a gaming network which may facilitate target interactive games according to aspects of the present invention, and is not intended to be limiting in any way. Reel-type games according to aspects of the present invention are not limited to use with gaming networks such as network 300.

FIGS. 4A and 4B show an example process of triggering and conducting bonus plays in a reel-type gaming machine in accordance with aspects of the present invention. In particular, FIG. 4A shows process steps associated with a base portion of a reel-type game and FIG. 4B shows process steps associated with a bonus portion of a game. It should be noted that the terms "base" and "bonus" are simply used here to distinguish different portions of play at a reel-type gaming machine. Generally, the base portion of the game includes an initial portion of play while the bonus portion includes a portion which is entered during or after the base portion of the game.

Referring to FIG. 4A, the illustrated method includes initializing the EGM (such as gaming machine/EGM 100 shown in FIGS. 1 and 3) at process block 402 and then receiving a game play input as shown at process block 404. Initializing the gaming machine as indicated at process block 402 in FIG. 4A may include, for example, receiving an input of credits for play from a player. Credits may be applied to the gaming machine through a voucher system, player account system, or any other arrangement. In any event, initializing the gaming machine places it in condition to receive game play inputs as indicated at process block 404. These game play inputs may be received in any suitable fashion, such as, for example, through a player actuated control such as a "Play" button or lever. Each game play input may be associated with a wager which is selected or entered by the player through a suitable control included in the player input system.

In response to the game play input, the process includes populating the game symbol locations in an initial array of game symbol locations as shown at process block 406. The game symbol locations are populated in this step from a first game symbol set which includes a first trigger symbol. This first trigger symbol includes a representation of a single-symbol reel. In some implementations in accordance with the aspects of the invention, the various game symbol locations in the initial array of game symbol locations are defined by a series of multiple-symbol reels or reel representations displayed by a video display of the gaming machine display system. In these implementations, populating the game symbol locations as indicated at process block 406 includes conducting a spin for physical reels or a spin simulation for video simulated reels, and then causing the reels or simulated reels to come to a stop with game symbols appearing on the reels aligning with the various game symbol locations of the initial array. Regardless of whether physical or video simulated reels are employed to populate the initial array of game symbol locations, implementations of the invention may include sequentially stopping the multiple-symbol reels so that groups (columns for vertically oriented reels) of game symbol locations are populated while other reels remain spinning until they are brought to a stop in the desired sequence.

In the event any of the game symbol locations are populated with the first trigger symbol as indicated by an affirmative result at decision box 407, the process proceeds to perform a simulated reel spin for the single-symbol reel representation included in that first trigger symbol as shown at process block 408. This single-symbol reel spin simulation is conducted with a second game symbol set which includes a second trigger symbol. It will be appreciated that where the reels which define the initial array of game symbol locations are physical reels, the gaming machine display system will require some arrangement for conducting the single-symbol reel spin simulation at the location populated with the first trigger symbol. Such an arrangement might include a video display forming at least a portion of the reel strip carried by the physical reel. The single-symbol reel spin simulation at process block 408 may also be accomplished with a light-transmissive video display located over the physical reel.

Any of the reel spin simulations described herein may be performed under the control reel spin simulator program code executed by a processor associated with the gaming machine. This reel spin simulator code will be executed referencing a data structure or structures defining the various game symbols of the set of game symbols from which the given game symbol locations provided by the simulated reel are to be populated. Thus in this disclosure and the accompanying claims a reference to conducting a reel spin simulation with a given game symbol set means that the reel spin simulator code employs a data structure defining the given game symbol set. The reel spin simulator code may also require inputs for other parameters (such as the number of game symbol locations to be populated for the given simulation) to conduct the simulated spin as desired.

The process shown in FIG. 4A assumes that the various game symbol locations of the initial array are populated sequentially, and thus the process loops back to populate the next game symbol location or group of game symbol locations in the populating sequence. As indicated by decision boxes 407 and 409, this loop occurs whether a first trigger symbol is included in the group of one or more game symbol locations populated in accordance with process block 406 or otherwise. Regardless of whether the reels defining the initial array of game symbol locations are stopped sequentially or otherwise, conducting the single-symbol reel spin simulations indicated at process block 408 for each first trigger symbol landing in the initial array of game symbol locations produces a second level game symbol array in the initial array of game symbol locations. In this second level game symbol array, each location which has included the single-symbol reel spin simulation indicated at process block 408 will be populated with game symbols from the second game symbol set and thus one or more of these locations may be populated with the second trigger symbol. A bonus trigger may be defined as the occurrence of some minimum number of second trigger symbols included in the second level game symbol array.

In the event no bonus trigger is included in the second level game symbol array as indicated by negative outcome at decision box 410, the process then branches to process block 412 for the system to display and award prizes for the play in the game. After the prizes are displayed and awarded at process block 412, the player may cash out by actuating a control for that purpose included at the gaming machine. If the player actuates the control or controls needed to cash out at the gaming machine as indicated by an affirmative outcome at decision box 414, the process branches to the cash out process shown at block 415. If the player does not actuate the controls need to cash out, the process proceeds back to await another game play input at process block 404. The cash out process at block 415 may include any suitable process depending upon the credit system used for the gaming machine. For example, the gaming machine may issue a physical voucher to the player which may be cashed at the gaming establishment or may be inserted into another gaming machine to initialize that gaming machine for play.

The process indicated process block 412 in FIG. 4A may be performed in any suitable fashion known in gaming systems or hereafter developed. Typically, an award of a prize from the game play may be in the form of a credit value and displaying the award includes incrementing a player's credit meter at the gaming machine. Prizes for the base portion of the game may be defined in any suitable fashion such as, for example, in terms of predefined symbols aligned along a pay line defined through the initial array of game symbol locations. Prizes for the base portion of the game may also be awarded via scatter pays for example. As will be described further below in connection with the example of FIGS. 5-11, prizes for the bonus portion of the game (from the process shown in FIG. 4B) may be defined in terms of a number of jackpot symbols included in a bonus array of game symbol locations.

If the bonus play is triggered as indicated by an affirmative outcome at decision box 410 in FIG. 4A, the process moves to that shown in FIG. 4B. According to one aspect of the present invention, the bonus play is triggered from symbols shown in the initial array of game symbol locations as a result of the single-symbol reel spin simulations conducted according to process block 408. In particular, bonus play may be triggered based on a predefined number of second trigger symbols appearing in the initial array after the spins conducted according to process block 408. As will be described in the specific example shown in FIGS. 5-11 below, the second trigger symbol may be a single symbol. Alternatively, a second trigger symbol may be defined as a symbol from a group of two or more symbols.

Referring the FIG. 4B, the illustrated example bonus portion of the play initiated in response to the input received at 404 in FIG. 4A includes first modifying the initial array of game symbol locations to produce a bonus array of game symbol locations as indicated at process block 418 in FIG. 4B. This modification to produce the bonus array of game symbol locations may include moving one or more of the game symbol locations relative to at least one other game symbol location to separate the initial array of game symbol locations to form a bonus array of game symbol locations. The bonus array would then include a first bonus group of game symbol locations and a second bonus group of game symbol locations. The modification at 418 may also or alternatively include adding one or more additional bonus groups of game symbol locations. In this latter case the bonus array of game symbol locations would include more locations than the initial array of game symbol locations. As will be described below in connection with the example of FIGS. 5-11, these different bonus groups of game symbol locations may be used to define prizes for the bonus portion of play. In particular, prizes may be awarded when a predefined number of a particular type of game symbol is shown in a given bonus group of game symbol locations at the conclusion of the bonus portion of play.

The example bonus play process shown in FIG. 4B includes multiple spins of the various simulated or physical reels which define the bonus array of game symbol locations. Thus process block 418 includes setting a spin counter with the number of spins remaining in the bonus play. The example process also shows that a bonus play input must be received as indicated at process block 419 in order to initiate a spin awarded in the bonus play. Such a player input may simply be an actuation of a "Play" button or other control at the gaming machine. It is also possible that the player input indicated at block 419 may require an additional wager. However, implementations may not require additional wagers for initiating the awarded bonus play spins, and such spins may be implemented as free spins. It should be appreciated that other implementations of the invention may not require a player input as indicated at process block 419, in which case the awarded bonus spins are conducted automatically without player intervention. In any event, initiating one of the awarded bonus spins causes the spin counter to be decremented as shown at process block 420 in the example process of FIG. 4B.

The process in FIG. 4B next proceeds to populate the game symbol locations in the bonus array of game symbol locations as indicated at process block 422. This populating of game symbol locations may be performed by conducting a respective single-symbol reel spin simulation of the single-symbol reel representation at the respective location. These single-symbol reel spin simulations may be conducted using a third game symbol set which includes one or more jackpot symbols, and are shown in FIG. 4B as being conducted sequentially.

Some implementations of the invention may not conduct a single-symbol reel spin simulation for every game symbol location included in the bonus array of game symbol locations. In particular, implementations of the invention may lock in place certain symbols which landed in the base portion of the play. One preferred arrangement locks in place any first trigger symbol which lands in the base portion of play. This locking in place may also include any symbol from the second set of game symbols landing in a single-symbol reel spin conducted at process block 408 in FIG. 4A. The benefit of locking such symbols in place will be apparent from the arrangement for awarding jackpot prizes described below particularly in connection with the example of FIGS. 5-11.

In the event the respective game symbol location is populated with one of the jackpot symbols as indicated by an affirmative outcome at decision box 424, the example process then conducts an additional single-symbol reel spin simulation at that location as indicated at process block 426. This additional single-symbol reel spin simulation may be conducted using a set of game symbols which includes only additional jackpot symbols. Implementations of the invention may also include locking any additional jackpot symbols in place for the remainder of the bonus play. The illustrated example process also increments the spin counter in the event a jackpot symbol lands as shown process block 428. This step may include restoring an initial value for the counter for example, or incrementing by some predefined or variable value.

If the last game symbol location to be populated has not yet landed as indicated by a negative outcome at decision box 429, the process loops back to process block 422. Otherwise, if all of the single-symbol reel simulations are complete as indicated by an affirmative outcome at decision box 429, the process continues on to determine if another bonus game activation is available in this example. Once the spin counter reaches zero as indicated by an affirmative outcome at decision box 430 in the example process shown in FIG. 4B, the process loops back to the display and awarding prizes step at process block 412 of FIG. 4A. If the spin counter indicates spins in the bonus game remain, but if all locations in the bonus array of game symbol locations are locked as indicated by an affirmative outcome at decision box 432, the process also proceeds back to process block 412 of FIG. 4A. Otherwise the process returns to receive another bonus play input representing another spin of the reels of the remaining unlocked symbol locations of the bonus array of game symbol locations at process block 419.

It will be appreciated that the various process steps indicated in FIGS. 4A and 4B may be conducted by the hardware of a reel-type gaming machine under control of program code. In particular, first level game program code may be executed to populate the game symbol locations of the initial array as indicated a 404 in FIG. 4A, while second level game program code may be executed to detect the presence of a first trigger symbol and perform the simulation indicated at process block 408 in FIG. 4A. Prize assignment program code may be executed to perform the display and award of prizes indicated at 412 in FIG. 4A. Bonus game program code may be executed to identify the presence of a bonus trigger as indicated at 410 in FIG. 4A, and perform the processes described in FIG. 4B.

The invention encompasses numerous variations on the process steps set out for purposes of example in FIGS. 4A and 4B. For example, any of the game symbols and particularly any of the trigger symbols or jackpot symbols may include numerical values. These numerical values may comprise credits which will be awarded along with any other prize obtained in the course of the play. The following example of FIGS. 5 through 11 shows such an arrangement. Where such numerical values are used, the values may be tied to a bet multiplier in effect for a given play. In these cases, changing the multiplier may have the effect of changing one or more values of these numerical values associated with the various game symbols. In particular, applying a multiplier to a bet entered at the gaming machine for a given game play input may have the effect of multiplying a base numerical value by that same multiplier value.

Figure 5:
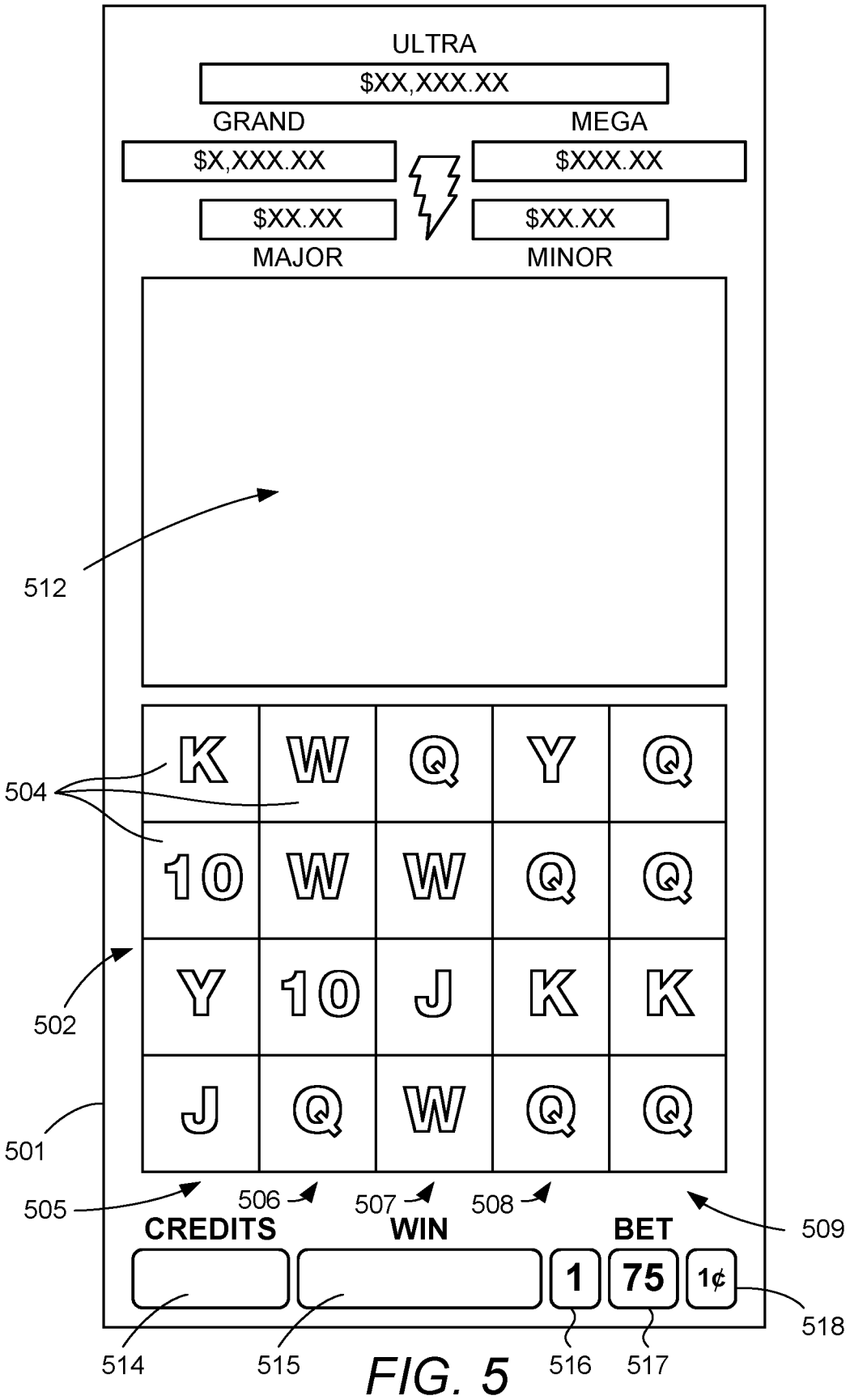
FIG. 5 is a representation of a first point in time of a play in a reel-type game in accordance with aspects of the present invention

FIGS. 5 through 11 may now be used to describe a specific implementation of a process as outlined in FIGS. 4A and 4B. Referring first to FIG. 5, the example reel-type game includes graphics displayed in an area 501 which may be provided by a video display device such as display 104 shown in FIG. 1. The displayed graphics include an initial array of game symbol location made up of an array 502 of twenty locations 504. In this example, each column of four locations 504 is defined by a multiple-symbol reel representation including a first reel 505, a second reel 506, a third reel 507, a fourth reel 508, and a fifth reel 509. In the state of the display shown in FIG. 5, a play in a base portion of the game has been completed without triggering bonus play and no winning combinations of game symbols being displayed in the base portion of play. For the purpose of this example, the game symbols other than the trigger symbols and jackpot symbols are selected from the group A, K, Q, J, 10, V, W, X, Y, and Z.

In addition to initial array 502 of game symbol locations 504, the illustrated game graphics also include an area shown at 512 for various game graphics or information at this stage of the game. This area 512 is shown blank for purposes of this description but it will be appreciated that the area may be used to display theme graphics for the game and/or information such as pay tables for the base portion of play and other information. The illustrated game graphics also include an area 514 for showing credits available for play, an area 515 showing an amount of a win for the most recent play of the game, a multiplier display area 516, a bet level display area 517, and a denomination display area 518. Of these display areas, area 514 and area 515 are shown blank for purposes of this description. It will be appreciated, however, that these areas would show credit values in an actual implementation.

The example of FIG. 5 also shows a number of jackpot prize values in the display area 501. These prize values are displayed as variables for the purposes of this description, and include an "Ultra" jackpot prize, lower value "Grand" and "Mega" jackpot prizes, and lower still "Major" and "Minor" prizes. The value of these prizes in an actual implementation of the game may be fixed values or values which vary in some fashion over time. One or more of the jackpot prizes might be defined as a local or wide area progressive prize which increases substantially continuously based on the value of wagers placed in the gaming system. The prizes may be shown as currency values as indicated in the figures, or as credit values. As will be discussed further below in connection with FIGS. 9-11, the illustrated jackpot prizes may be available as prizes for the bonus portion of the game.

Figure 6:
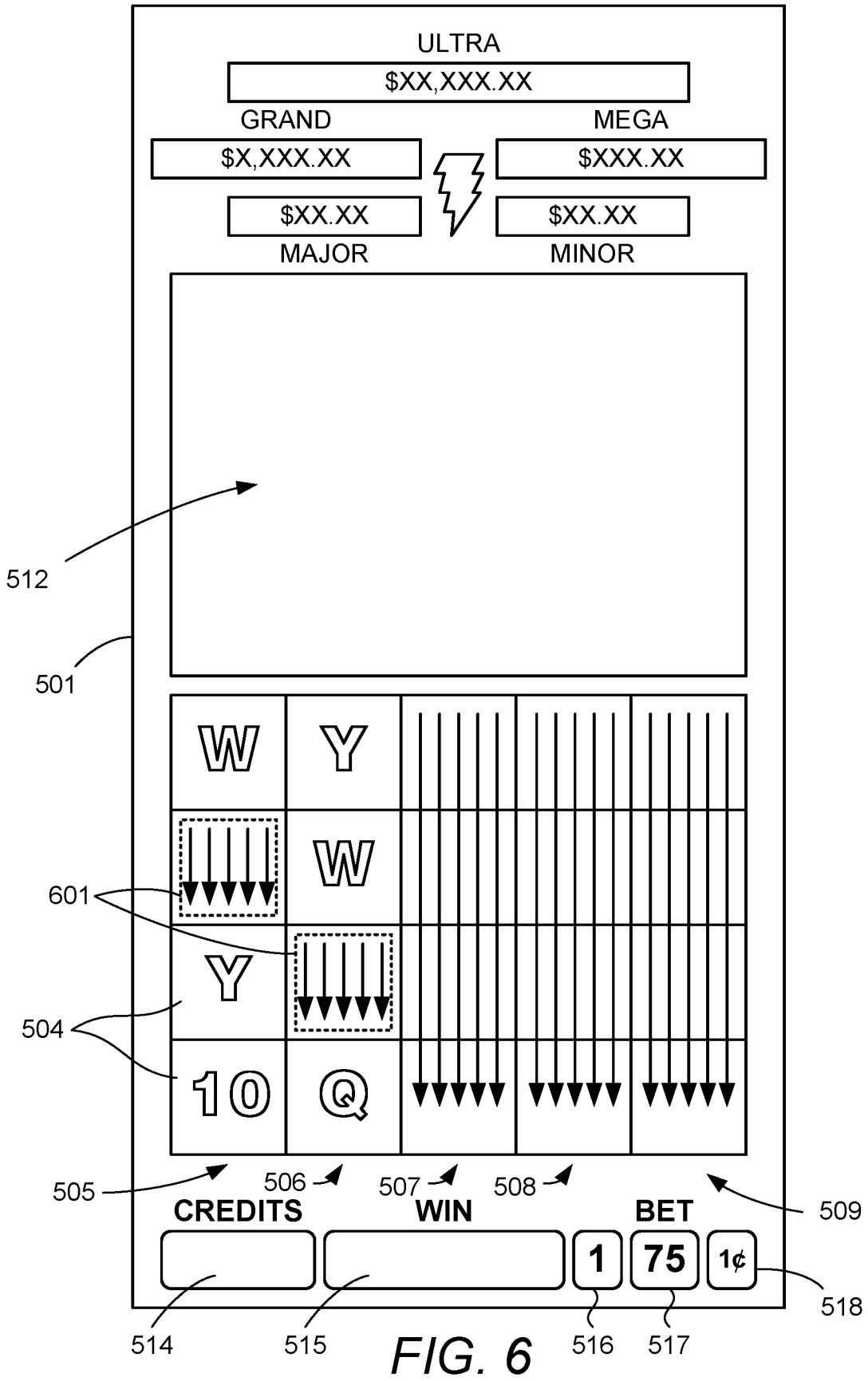
FIG. 6 is a representation of a second point in time of the play in the reel-type game depicted in FIG. 5.

FIG. 6 shows a state of base portion of a game play in which only a portion of the base game result has been displayed and some reel spin simulations remain underway. In this state of the game, multiple-symbol reels 505 and 506 have each come to a stop to populate the two leftmost columns of symbol locations 504 in the initial array 502 (in accordance with the step shown at block 406 in FIG. 4B). Multiple-symbol reels 507, 508, and 509 remain spinning as indicated by the arrows over those reels. In the state of the base portion of play shown in FIG. 6, the second symbol location from the top of reel 505 has been populated with first trigger symbol indicated by the dashed line 601. A first trigger symbol 601 has also populated the third symbol location down on stopped reel 506. In the case of both first trigger symbols 601 shown in FIG. 6, the first trigger symbol has prompted a respective single-symbol reel spin simulation (in accordance with block 408 in FIG. 4A) with the spinning motion indicated by arrows within the area of first trigger symbol 601. In this particular implementation, the single-symbol reel spin simulations triggered by first trigger symbol 601 each continue until each of the multiple-symbol reels have come to a stop to populate all of the game symbol locations of the initial array. Once all of the game symbol locations 504 of the initial array have been populated, the single-symbol reel spin simulations triggered by the first trigger symbol 601 will each stop sequentially across the array in this particular implementation of the invention.

Figure 7:
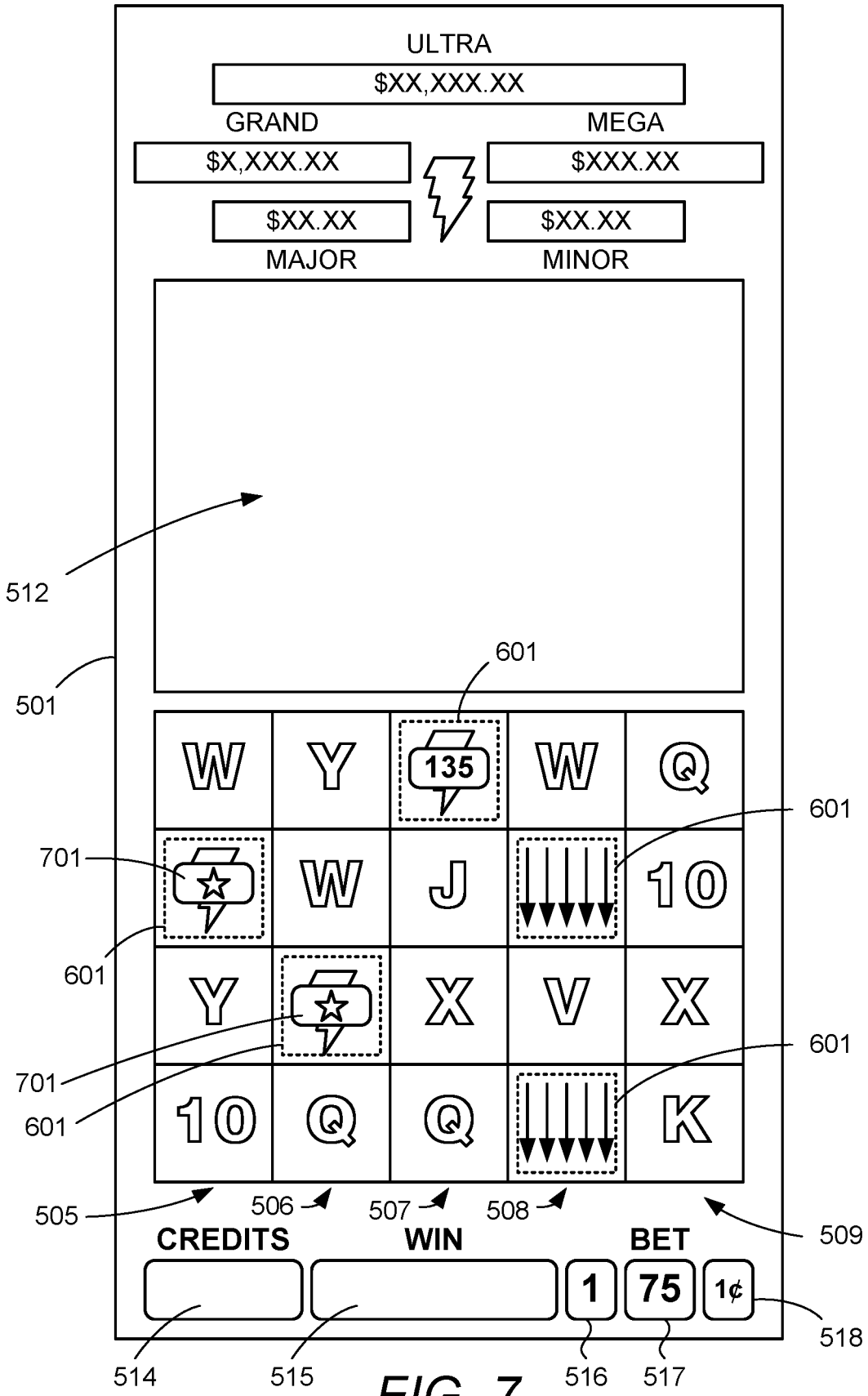
FIG. 7 is a representation of a third point in time of the play in the reel-type game depicted in FIG. 5.

FIG. 7 shows a state of the base portion of play in which all of the multiple symbol reels, 505, 506, 507, 508, and 509 have come to a stop to populate each game symbol location 504 in initial array 502. Also, in the game state depicted in FIG. 7, some of the symbol locations which have been populated with the first trigger symbol 601 have performed the respective single-symbol reel spin simulation and have come to a stop to display a game symbol selected from the second game symbol set. Namely, the second symbol location of the column defined by first reel 505 has been populated with the first trigger symbol 601 and the subsequent single-symbol reel spin simulation at that location has stopped to show a second trigger symbol 701 included in the second game symbol set. The third symbol location of the second reel 506 has also completed the single-symbol reel spin simulation to show a second trigger symbol 701. The first game symbol location of the column defined by third reel 507 has also been populated by the first trigger symbol 601, and the subsequent single-symbol reel spin simulation at that location has stopped to show a symbol including a numerical value (135) to be awarded to the player for the play of the game. Finally with respect to FIG. 7, the second and fourth game symbol locations of the column defined by fourth reel 508 have landed on the first trigger symbol 601, but the subsequent single-symbol reel spins at those locations are ongoing as indicated by the arrows at those locations.

Figure 8:
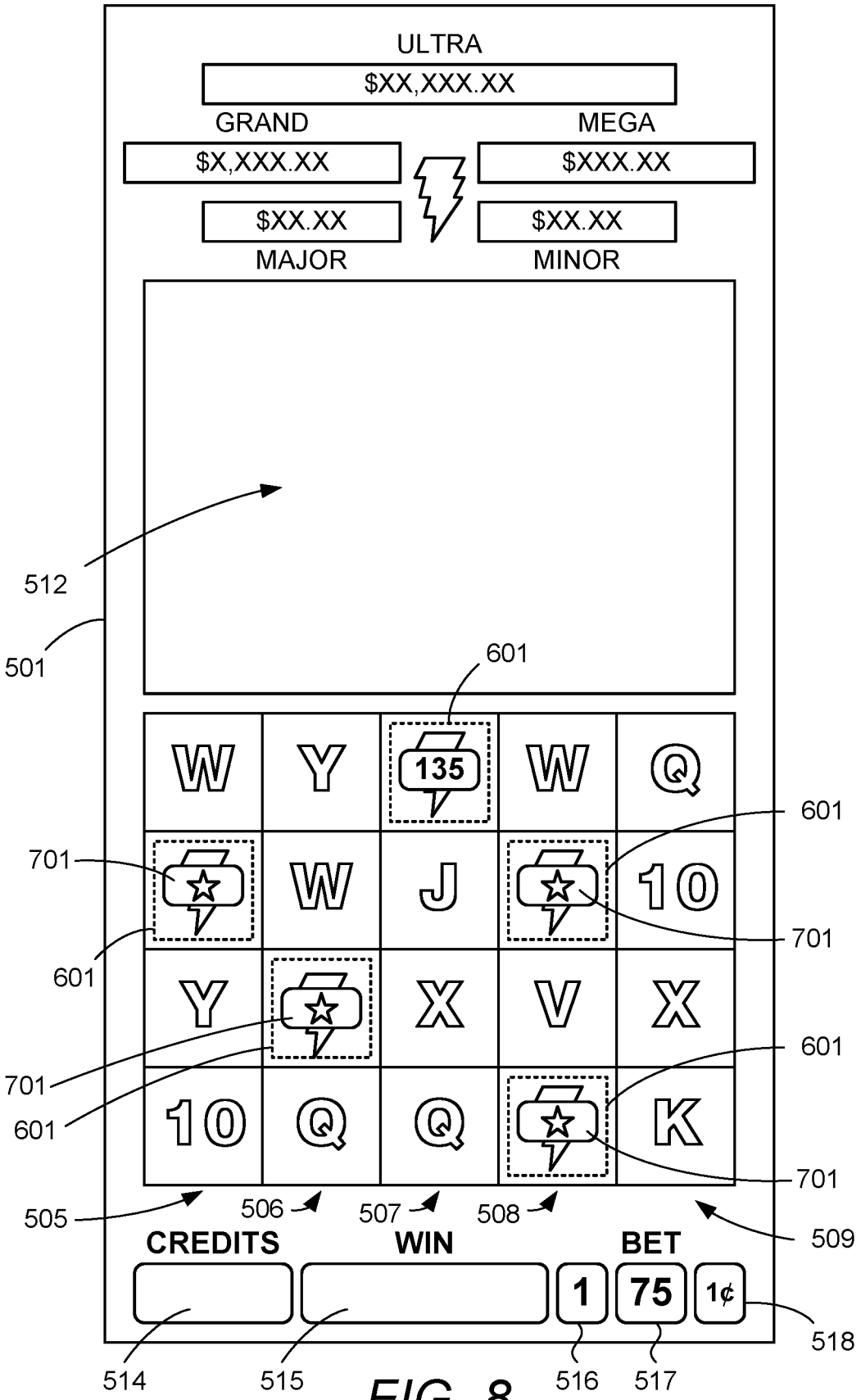
FIG. 8 is a representation of a fourth point in time of the play in the reel-type game depicted in FIG. 5.
Figure 10:
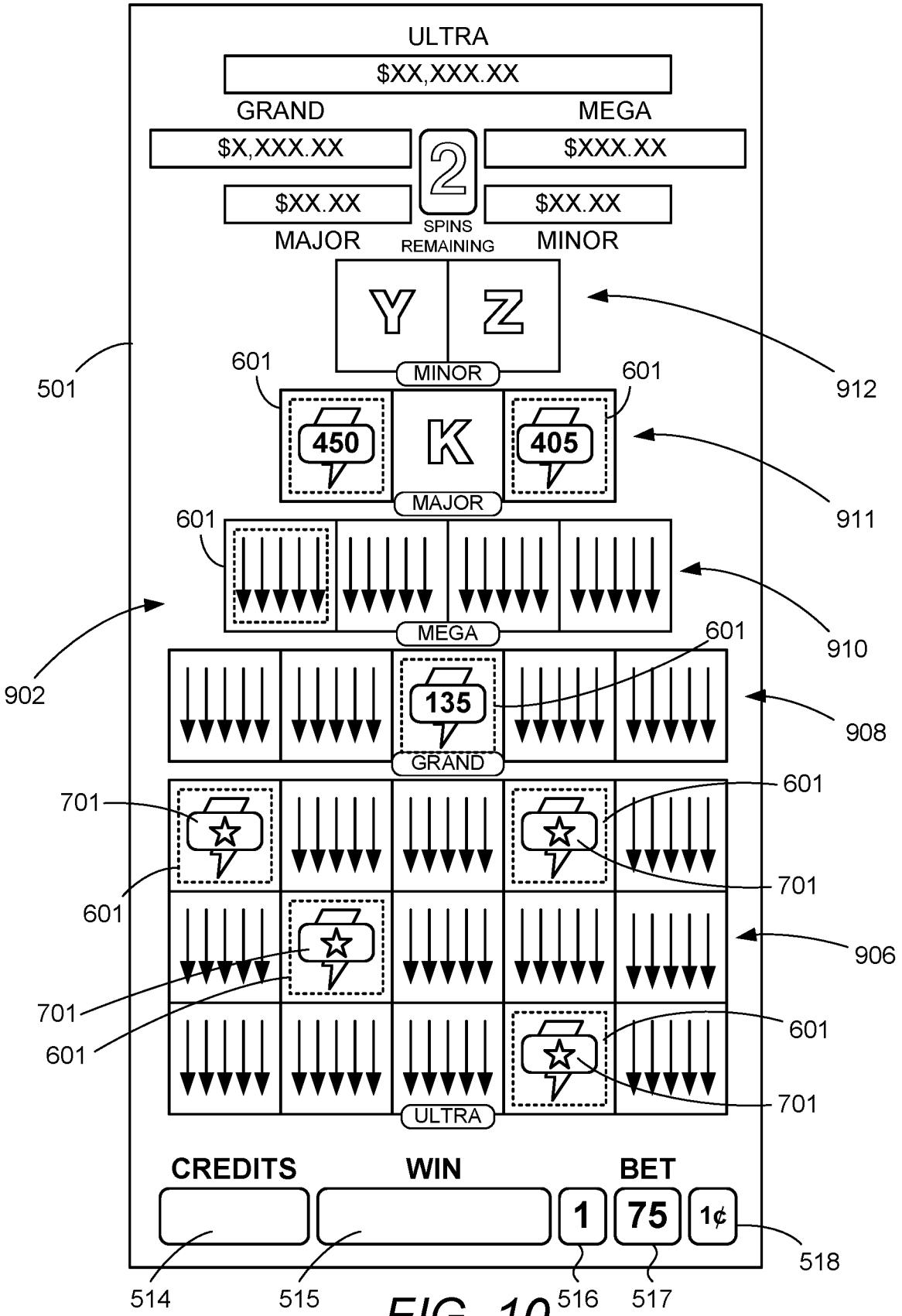
FIG. 10 is a representation of a sixth point in time of the play in the reel-type game depicted in FIG. 5.
Figure 11:
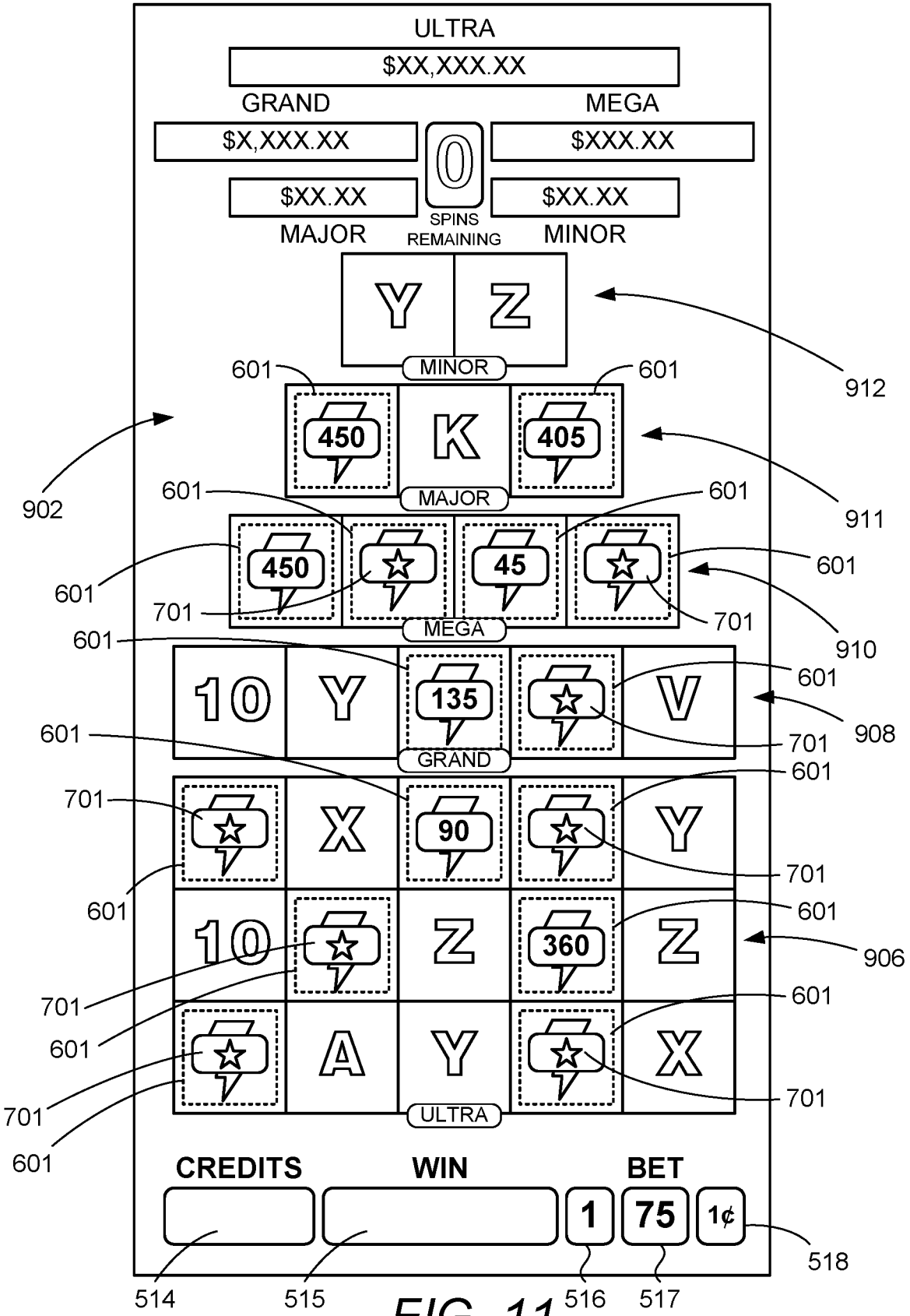
FIG. 11 is a representation of a seventh point in time of the play in the reel-type game depicted in FIG. 5.

FIG. 8 shows a state of the game in which the base portion is complete. The single-symbol reel spin simulations at the second and fourth game symbol locations of the column defined by fourth reel 508 have each completed to show the second trigger symbol 701. For the purposes of this example, it will be assumed that the bonus game trigger is defined for the game as four or more second trigger symbols 701 appearing in the initial array at the completion of the base portion of the game. Since this condition is met by the game symbols shown in array 502 in FIG. 8 (corresponding to an affirmative outcome at decision box 410 in FIG. 4A), the game will proceed to the bonus portion (shown in FIG. 4B). This example bonus portion of play is shown in FIGS. 9-11.

Figure 9:
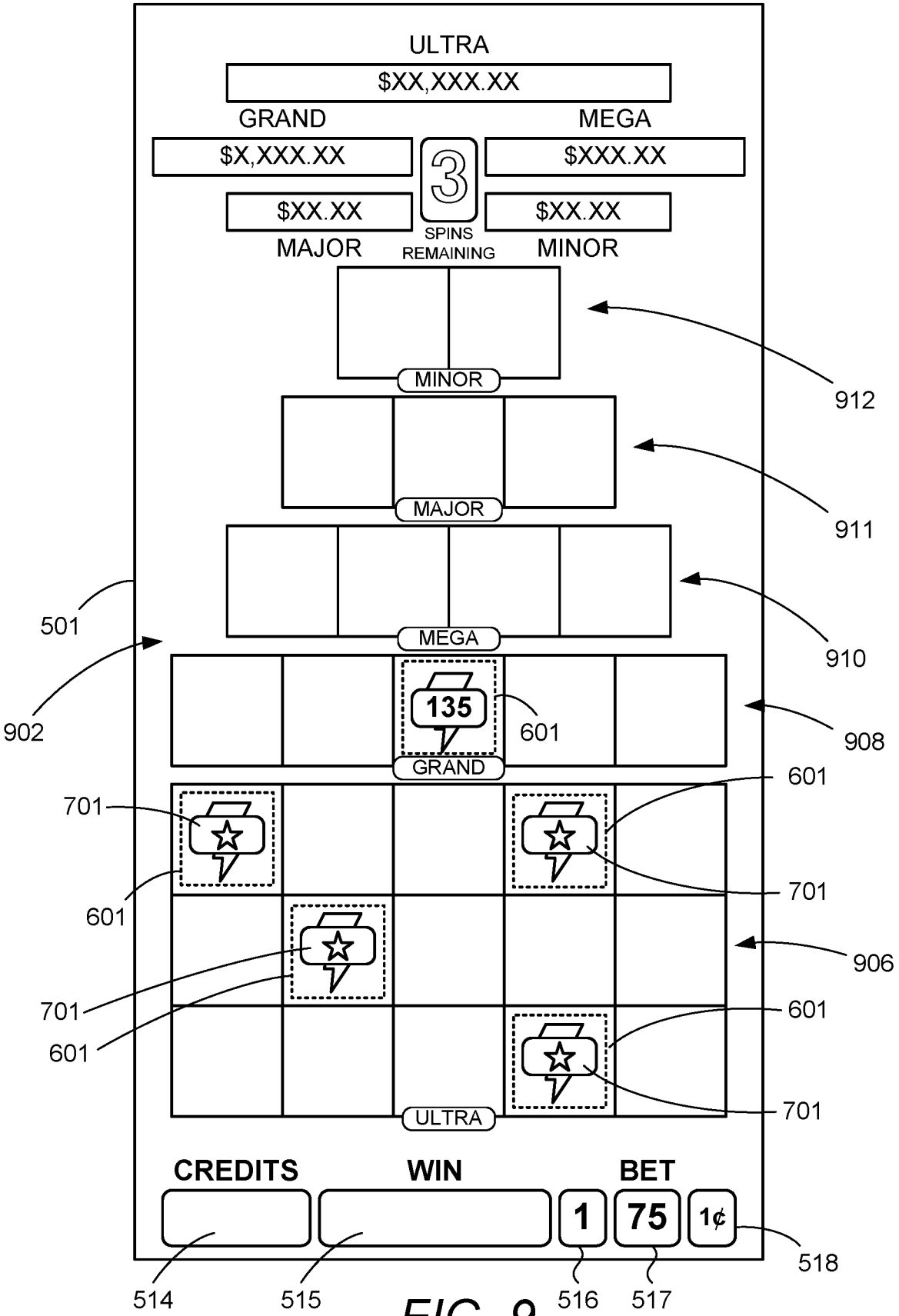
FIG. 9 is a representation of a fifth point in time of the play in the reel-type game depicted in FIG. 5.

FIG. 9 illustrates an initial state of the bonus portion of play. To reach this state from that shown in FIG. 8, the initial array 502 of game symbol locations 504 has been modified to produce a bonus array 902 of game symbol locations 504. In this example, the bonus array of game symbol locations is made in part by moving each game symbol location 504 of the upper row of game symbol locations from the initial array 502 (in FIGS. 5-8) upwardly with respect to the remainder of the game symbol locations in the initial array. This separation forms two visually distinct groups of game symbol locations in the bonus array 902. A first bonus group 906 of game symbol locations 504 is made up of the lowermost fifteen game symbol locations from the initial array. A second bonus group 908 of game symbol locations 504 is made up of the separated first row from the initial array as described above. The example bonus game portion shown in FIG. 9 also shows three additional bonus groups of game symbol locations 504 which are made up of additional game locations added to those shown in the initial array. In particular, a first additional bonus group 910 is made up of four additional game symbol locations 504, a second additional bonus group 911 is made up of three additional game symbol locations 504, and a third additional bonus group 912 is made up of two additional game symbol locations 504.

In the course of the bonus play in this example, each of the game symbol locations 504 in the bonus array 902 which is not locked (as described below) is populated with a game symbol for a given spin in the bonus play using a single-symbol reel spin simulation. The example bonus play provides an initial three spins, which may be free spins requiring no further wager. Thus FIG. 9 shows the spin counter initially set to "3." In some implementations, the spin counter may be reset to three spins (or some other number if additional spins added) if a certain type of game symbol lands for a given spin in the bonus play. For example, the game symbol sets used to populate each game symbol location 504 in bonus play may comprise the same sets used for spins in the base portion of the game including first trigger symbol 601, and if this first trigger symbol 601 lands on any game symbol location in one of the bonus spins, the spin counter may be reset or otherwise incremented.

In the illustrated game shown in FIGS. 5-11, any game symbol location 504 which is populated with a first trigger symbol 601 is locked in place for any subsequent spins (bonus play spins) in that given play of the game together with the symbol resulting from the subsequent single-symbol reel spin at that game symbol location. Thus, it will be noted when comparing FIG. 8 to FIG. 9, that the bonus array 902 of game symbol locations 504 retains the first trigger symbols 601 which landed in the base game portion, together with the symbols resulting from the subsequent single-symbol reel spin at that game symbol location. In the illustration of FIG. 9, any game symbol locations which are not locked are shown as empty in preparation for the single-symbol spins of the bonus play. Actual implementations may show some type of symbol in those locations in preparation for bonus play.

In the example bonus game portion illustrated in FIGS. 9-11, the prizes identified for the labels "Ultra," "Grand," "Mega," "Major," and "Minor" may be considered jackpot prizes and are awarded when the different bonus groups of game locations are filled with certain game symbols over the course of the bonus play. In particular, in this example implementation, each jackpot prize is associated with a given bonus group of game symbol locations as indicated by the common labelling shown in FIGS. 9-12. The "Ultra" prize is associated with first bonus group 906, the "Grand" prize is associated with second bonus group 908, the "Mega" prize is associated with bonus group 910, the "Major" prize is associated with bonus group 911, and the "Minor" prize is associated with bonus group 912. A given jackpot prize is awarded in this example when at the completion of the bonus play the corresponding bonus group of game symbol locations is populated with a first trigger symbol 601 (and any symbol resulting from the subsequent spin at that location). Thus the first trigger symbol would be considered a jackpot symbol in this implementation because it may populate game symbol locations to achieve a jackpot prize.

FIG. 10 shows a state of the example bonus play after a spin has been initiated for bonus array 902 in the state shown in FIG. 9. This example in FIG. 10 shows that the spins remaining counter has been decremented in view of the initiated spin. Both of the game symbol locations of the third additional bonus group 912 have been populated by the completion of the single-symbol reel spin simulation at those locations, as have all three game symbol locations of second additional bonus group 911. No prize awarding game symbols have populated the locations of group 912, while first trigger symbols 601 have populated the first and last locations of group 911. The subsequent single-symbol reel spin simulation at each of these locations have been completed to show game symbols including numerical values (450 and 405) representing credits to be awarded for the game play. The rightmost game symbol location in first additional bonus group 910 has been populated with a first trigger symbol 601 and the subsequent single-symbol reel spin simulation at that location remains spinning as do the spin simulations at the other game symbol locations of that group. All of the remaining game symbol locations are shown still spinning in FIG. 10 aside from the game symbol locations having symbols that have been previously locked in place.

FIG. 11 shows the state of bonus array 902 at the completion of the example bonus play some number of spins after the state shown in FIG. 10. In the course of the bonus play, several other of the game symbol locations 504 have been populated with a first trigger symbol 601 and the subsequent spin at some of these locations have landed game symbols showing additional numerical values to be awarded as credits for the play. In this example, each game symbol location included in the first additional bonus group 910 of game symbol locations 504 includes a first trigger symbol 601, which as described earlier represents a jackpot symbol for this example play. Thus in addition to the various numerical credit values to be awarded, this result awards the prize shown in the "Mega" field at the top of the display area.

The outcome of any game conducted in accordance with the present invention, that is, the prize to be awarded, may be determined in any suitable fashion. In some implementations the various reels may be designed so that they may be randomly stopped and will produce a desired payout and hold over time. Other implementations may obtain a random outcome or an outcome from another game such as "bingo" and then control the various reel spins according to the invention to correspond to that outcome.

One way to obtain a random outcome (in terms of prize value) to be displayed through the play described herein uses a random number generator to generate a random number which is used to index a table to lookup an outcome. In such an arrangement, the outcomes are stored in a lookup table which is indexed by the random number to provide suitable distributed, randomly-selected results. The lookup table may have a number of outcome entries, each with an index, a prize amount in credits, and a bonus flag. The outcome entry may have other data fields to control other parts of the game. The bonus flag indicates that the outcome is to be displayed with both the base and bonus portion of game play described above.

As one alternative to a game outcome determined by random number, outcomes may be selected from an outcome record pool of predetermined outcome records. In those arrangements, an outcome record may be chosen from a record pool in order to service a play initiated at the gaming machine. Such an outcome record may be chosen from the pool either randomly or from a randomly-organized queue. The chosen record may include a record identifier (rather than an index), a prize amount, and a free-spin bonus flag. An outcome record may have other data fields to control other parts of the game. The free-spin bonus flag indicates that the record outcome will trigger the bonus portion of play. Still other implementations may use a server-hosted bingo game with multiple game play requests participating as bingo cards, the bingo patterns determining prize outcomes.

In some implementations of the invention, one or both of the base portion of play or the bonus portion of play may be controlled by a script which controls the various reel spins to land on game symbols to produce the randomly selected or otherwise obtained outcome for the play. In order to provide a natural feel to the play of the game, numerous scripts may be stored for each potential outcome and the particular script to be used to control the game for a given play may be selected randomly from the scripts available to show the given outcome.

Numerous variations are possible on the example processes described in connection with FIGS. 4A and 4B and in connection with FIGS. 5-11. For example, the method of triggering a bonus portion of play as shown in FIG. 4A may be used to trigger types of bonus play other than that shown in FIG. 4B. Similarly, the particular bonus play arrangement shown in FIG. 4B may be used with other bonus play trigger arrangements and is not limited to the process shown in FIG. 4A. Another variation may be that the bonus play process described in FIG. 4A and FIGS. 9-11 may not require rearranging the initial array of game symbol locations to produce a bonus array of game symbol locations.

As used herein, whether in the above description or the following claims, the terms "comprising," "including," "carrying," "having," "containing," "involving," and the like are to be understood to be open-ended, that is, to mean including but not limited to. Also, it should be understood that the terms "about," "substantially," and like terms used herein when referring to a dimension or characteristic of a component indicate that the described dimension/characteristic is not a strict boundary or parameter and does not exclude variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Any use of ordinal terms such as "first," "second," "third," etc., in the following claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

In the above descriptions and the following claims, terms such as top, bottom, upper, lower, and the like with reference to a given feature are intended only to identify a given feature and distinguish that feature from other features. Unless specifically stated otherwise, such terms are not intended to convey any spatial or temporal relationship for the feature relative to any other feature.

The term "each" may be used in the following claims for convenience in describing characteristics or features of multiple elements, and any such use of the term "each" is in the inclusive sense unless specifically stated otherwise. For example, if a claim defines two or more elements as "each" having a characteristic or feature, the use of the term "each" is not intended to exclude from the claim scope a situation having a third one of the elements which does not have the defined characteristic or feature.

The above described preferred embodiments are intended to illustrate the principles of the invention, but not to limit the scope of the invention. Various other embodiments and modifications to these preferred embodiments may be made by those skilled in the art without departing from the scope of the present invention. For example, in some instances, one or more features disclosed in connection with one embodiment can be used alone or in combination with one or more features of one or more other embodiments. More generally, the various features described herein may be used in any working combination.

The invention claimed is:

1. A method of controlling a reel-type gaming machine, the method including:

(a) controlling a display system of the gaming machine to display a first level game symbol array for a play at the gaming machine by populating at least some game symbol locations included in an initial array of game symbol locations, each respective game symbol location of the at least some game symbol locations being populated with a respective game symbol selected from a first game symbol set which includes a first trigger symbol, the first trigger symbol including a representation of a single-symbol reel;

(b) controlling the display system of the gaming machine to display a second level game symbol array by, for each respective game symbol location populated with the first trigger symbol in the first level game symbol array, conducting a respective single-symbol reel spin simulation of the representation of the single-symbol reel, the respective single-symbol reel spin simulation being conducted with a second game symbol set which includes a second trigger symbol;

(c) at least in part in response to a predefined number of second trigger symbols being included in the second level game symbol array, controlling the display system to display a bonus play to show a bonus game result; and (d) controlling the gaming machine to award any prize defined for a winning game symbol group contained in the second level game symbol array, and award any prize defined for the bonus game result.

2. The method of claim 1 wherein the initial array of game symbol locations is defined by game symbol locations of two or more multiple-symbol reel representations and the at least some game symbol locations are populated by conducting one or more multiple-symbol reel spin simulations for each of the two or more multiple-symbol reel representations.

3. The method of claim 1 wherein controlling the display system to display the bonus play includes:

(a) through the display system of the gaming machine, moving one or more of the game symbol locations relative to at least one other game symbol location to separate the initial array of game symbol locations to form a bonus array of game symbol locations, the bonus array of game symbol locations including game symbol locations of the initial array of game symbol locations arranged in at least a first bonus group of game symbol locations and a second bonus group of game symbol locations;

(b) through the display system of the gaming machine, displaying a bonus level game symbol array by, for each of at least some of the game symbol locations in the bonus array of game symbol locations, conducting a respective single-symbol reel spin simulation with a third game symbol set which includes one or more jackpot symbols; and (c) wherein a prize is defined for the bonus game result in terms of a number of the jackpot symbols included in at least one of the first bonus group of game symbol locations and second bonus group of game symbol locations.

4. The method of claim 3:

(a) further including, through the display system of the gaming machine, adding at least one additional bonus group of game symbol locations to increase the number of game symbol locations included in the bonus array of game symbol locations relative to the initial array of game symbol locations;

(b) wherein displaying the bonus level game symbol array includes, for each of at least some of the game symbol locations included in the at least one additional bonus group of game symbol locations, conducting a respective single-symbol reel spin simulation with the third game symbol set; and (c) wherein an additional prize is defined for the bonus game result by a number of the jackpot symbols included in the at least one additional bonus group of game symbol locations.

5. The method of claim 3:

(a) wherein displaying the bonus level game symbol array includes conducting a respective single-symbol reel spin simulation with the third game symbol set multiple times for at least some of the game symbol locations in the bonus array of game symbol locations;

(b) further including for one or more of the game symbol locations which has been populated with the first trigger symbol in the first level game symbol array, locking the game symbol populating that respective game symbol location in the second level game symbol array for a duration of the bonus play; and (c) further including for one or more of the game symbol locations which has been populated with one of the one or more jackpot symbols in the bonus play, locking the game symbol populating that respective game symbol location for a remainder of the duration of the bonus play.

6. The method of claim 3 wherein the second game symbol set and third game symbol set are each made up of the same game symbols.

7. The method of claim 3 wherein:

(a) the second game symbol set and third game symbol set include one or more game symbols showing a numerical value; and (b) awarding any prize defined by for the bonus game result includes awarding each numerical value shown in the bonus level game symbol array.

8. The method of claim 7 further including changing the numerical value shown in the one or more game symbols in response to a change in a multiplier in effect for the play at the gaming machine.

9. A gaming machine, the gaming machine including:

(a) a display system;

(b) a player input system;

(c) at least one processor; and (d) at least one memory device storing instructions executable by the at least one processor to:

(i) cause the display system to display a first level game symbol array for a play at the gaming machine by populating at least some game symbol locations included in an initial array of game symbol locations, each respective game symbol location of the at least some game symbol locations being populated with a respective game symbol selected from a first game symbol set which includes a first trigger symbol, the first trigger symbol including a representation of a single-symbol reel, (ii) cause the display system of the gaming machine to display a second level game symbol array by, for each respective game symbol location populated with the first trigger symbol in the first level game symbol array, conducting a respective single-symbol reel spin simulation of the representation of the single-symbol reel, the respective single-symbol reel spin simulation being conducted with a second game symbol set which includes a second trigger symbol, (iii) at least in part in response to a predefined number of second trigger symbols being included in the second level game symbol array, display a bonus play through the display system of the gaming machine to show a bonus game result; and (iv) through the gaming machine, award any prize defined for a winning game symbol group contained in the second level game symbol array, and award any prize defined for the bonus game result.

10. The gaming machine of claim 9 wherein the initial array of game symbol locations is defined by game symbol locations of two or more multiple-symbol reel representations and the at least some game symbol locations are populated by conducting one or more multiple-symbol reel spin simulations for each of the two or more multiple-symbol reel representations.

11. The gaming machine of claim 10 wherein displaying the bonus play includes:

(a) through the display system of the gaming machine, moving one or more of the game symbol locations relative to at least one other game symbol location to separate the initial array of game symbol locations to form a bonus array of game symbol locations, the bonus array of game symbol locations including game symbol locations of the initial array of game symbol locations arranged in at least a first bonus group of game symbol locations and a second bonus group of game symbol locations;

(b) through the display system of the gaming machine, displaying a bonus level game symbol array by, for each of at least some of the game symbol locations in the bonus array of game symbol locations, conducting a respective single-symbol reel spin simulation with a third game symbol set which includes one or more jackpot symbols; and (c) wherein a prize is defined for the bonus game result in terms of a number of the jackpot symbols included in at least one of the first bonus group of game symbol locations and second bonus group of game symbol locations.

12. The gaming machine of claim 11:

(a) wherein the instructions are further executable by the at least one processor to, through the display system of the gaming machine, add at least one additional bonus group of game symbol locations to increase the number of game symbol locations included in the bonus array of game symbol locations relative to the initial array of game symbol locations;

(b) wherein displaying the bonus level game symbol array includes, for each of at least some of the game symbol locations included in the at least one additional bonus group of game symbol locations, conducting a respective single-symbol reel spin simulation with the third game symbol set; and (c) wherein an additional prize is defined for the bonus game result by a number of the jackpot symbols included in the at least one additional bonus group of game symbol locations.

13. The gaming machine of claim 11:

(a) wherein displaying the bonus level game symbol array includes conducting a respective single-symbol reel spin simulation with the third game symbol set multiple times for at least some of the game symbol locations in the bonus array of game symbol locations;

(b) further including for one or more of the game symbol locations which has been populated with the first trigger symbol in the first level game symbol array, locking the game symbol populating that respective game symbol location in the second level game symbol array for a duration of the bonus play; and (c) further including for one or more of the game symbol locations which has been populated with the one of the one or more jackpot symbols in the bonus play, locking the game symbol populating that respective game symbol location for a remainder of the duration of the bonus play.

14. The gaming machine of claim 11 wherein the second game symbol set and third game symbol set are each made up of the same game symbols.

15. The gaming machine of claim 11 wherein:

(a) the second game symbol set and third game symbol set include one or more game symbols showing a numerical value; and (b) awarding any prize defined for the bonus game result includes awarding each numerical value shown in the bonus level game symbol array.

16. The gaming machine of claim 15 further including changing the numerical value shown in the one or more game symbols in response to a change in a multiplier in effect for the play at the gaming machine.

17. A program product comprising one or more non-transitory computer readable data storage devices storing program code for a reel-type gaming machine, the program code including:

(a) first level game program code executable by at least one processor to cause a display system of the gaming machine to display a first level game symbol array for a play at the gaming machine by populating at least some game symbol locations included in an initial array of game symbol locations, each respective game symbol location of the at least some game symbol locations being populated with a respective game symbol selected from a first game symbol set which includes a first trigger symbol, the first trigger symbol including a representation of a single-symbol reel;

(b) second level game program code executable by the at least one processor to cause the display system of the gaming machine to display a second level game symbol array by, for each respective game symbol location populated with the first trigger symbol in the first level game symbol array, conducting a respective single-symbol reel spin simulation of the representation of the single-symbol reel, the respective single-symbol reel spin being conducted with a second game symbol set which includes a second trigger symbol;

(c) bonus game program code executable by the at least one processor to, at least in part in response to a predefined number of second trigger symbols being included in the second level game symbol array, conduct a bonus play through the display system of the gaming machine to show a bonus game result; and (d) prize assignment program code executable by the at least one processor to award any prize defined for a winning game symbol group contained in the second level game symbol array, and to award any prize defined for the bonus game result.

18. The program product of claim 17 wherein the bonus game program code is further executable to:

(a) through the display system of the gaming machine, move one or more of the game symbol locations relative to at least one other game symbol location to separate the initial array of game symbol locations to form a bonus array of game symbol locations, the bonus array of game symbol locations including game symbol locations of the initial array of game symbol locations arranged in at least a first bonus group of game symbol locations and a second bonus group of game symbol locations;

(b) through the display system of the reel-type gaming machine, display a bonus level game symbol array by, for each of at least some of the game symbol locations in the bonus array of game symbol locations, conducting a respective single-symbol reel spin simulation with a third game symbol set which includes one or more jackpot symbols; and (c) wherein a prize is defined for the bonus game result in terms of a number of the jackpot symbols included in at least one of the first bonus group of game symbol locations and second bonus group of game symbol locations.

19. The program product of claim 18 wherein:

(a) the bonus game program code is further executable to through the display system of the reel-type gaming machine, adding at least one additional bonus group of game symbol locations to increase the number of game symbol locations included in the bonus array of game symbol locations relative to the initial array of game symbol locations;

(b) wherein displaying the bonus level game symbol array includes, for each of at least some of the game symbol locations included in the at least one additional bonus group of game symbol locations, conducting a respective single-symbol reel spin simulation with the third game symbol set; and (c) wherein an additional prize is defined for the bonus game result by a number of the jackpot symbols included in the at least one additional bonus group of game symbol locations.

20. The program product of claim 18:

(a) wherein displaying the bonus level game symbol array includes conducting a respective single-symbol reel spin simulation with the third game symbol set multiple times for at least some of the game symbol locations in the bonus array of game symbol locations;

(b) further including for one or more of the game symbol locations which has been populated with the first trigger symbol in the first level game symbol array, locking the game symbol populating that respective game symbol location in the second level game symbol array for a duration of the bonus play; and (c) further including for one or more of the game symbol locations which has been populated with the one of the one or more jackpot symbols in the bonus play, locking the game symbol populating that respective game symbol location for a remainder of the duration of the bonus play.

* * * * *